US006834936B2

(12) United States Patent
Teshigawara et al.

(10) Patent No.: US 6,834,936 B2
(45) Date of Patent: Dec. 28, 2004

(54) INK JET PRINTING APPARATUS AND INK JET PRINTING METHOD

(75) Inventors: Minoru Teshigawara, Kanagawa (JP); Naoji Otsuka, Kanagawa (JP); Kiichiro Takahashi, Kanagawa (JP); Hitoshi Nishikori, Tokyo (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/435,465

(22) Filed: May 12, 2003

(65) Prior Publication Data

US 2003/0214555 A1 Nov. 20, 2003

(30) Foreign Application Priority Data

May 15, 2002 (JP) ..... 2002-140760

(51) Int. Cl.[7] ..... B41J 2/21; B41J 2/145; B41J 2/15

(52) U.S. Cl. ..... 347/43; 347/40

(58) Field of Search ..... 347/40, 43, 16, 347/9, 12; 358/1.18, 298

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,593,295 A | * | 6/1986 | Matsufuji et al. | 347/43 |
| 4,723,129 A | | 2/1988 | Endo et al. | 346/1.1 |
| 4,740,796 A | | 4/1988 | Endo et al. | 346/1.1 |
| 5,790,150 A | * | 8/1998 | Lidke et al. | 347/41 |
| 6,042,212 A | | 3/2000 | Takahashi et al. | 347/15 |
| 6,254,217 B1 | | 7/2001 | Askeland et al. | 347/43 |
| 6,595,612 B1 | * | 7/2003 | Brown et al. | 347/9 |
| 2002/0154182 A1 | | 10/2002 | Takahashi et al. | 347/12 |

FOREIGN PATENT DOCUMENTS

| | | |
|---|---|---|
| JP | 54-056847 A | 5/1979 |
| JP | 59-123670 A | 7/1984 |
| JP | 59-138461 A | 8/1984 |
| JP | 60-071260 A | 4/1985 |

* cited by examiner

*Primary Examiner*—Thinh Nguyen

(57) ABSTRACT

Two print heads combined for each ink color are arranged symmetric to each other with respect to the scan direction and are used for a bidirectional printing. In producing secondary colors, image data is spread-processed by using a "diagonal arrangement" spread pattern to differentiate the ink application order at one of dots arranged in the raster direction from those of the other dots and thereby reduce color variations in the scan direction. Further, when image data has a half-tone, a "horizontal arrangement" spread pattern, different from the previous one, is used to perform image processing on the image data to alleviate an undesired texture. To prevent a driving load from concentrating on only one of the paired print heads, the number of times that each nozzle is driven is counted and an adjustment is made to spread the frequency of use among the two paired print heads.

22 Claims, 17 Drawing Sheets

INPUT DATA

ONLY LEVEL 1
(2-BIT 01 DATA)

ONLY LEVEL 2
(2-BIT 10 DATA)

INK JET PRINTING APPARATUS AND INK JET PRINTING METHOD

This application claims priority from Japanese Patent Application No. 2002-140760 filed May 15, 2002, which is incorporated hereinto by reference.

BACKGROUND OF THE INVENTION

1. Field of the Invention

The present invention relates to an ink jet printing apparatus and an ink jet printing method in which print heads for ejecting multiple color inks are scanned in two opposite directions for color printing. More specifically, the invention relates to an ink jet printing apparatus and an ink jet printing method which can alleviate color variations that occur during a color printing operation performed by reciprocal scanning or bidirectional scanning.

2. Description of the Related Art

In a printing apparatus, particularly an ink jet printing apparatus, an improvement on a color printing speed has become an important issue. Among possible methods for improving the printing speed are an increasing of the length of print heads and an enhancement of print head drive frequency. In a serial type printing apparatus, which performs printing by scanning the print heads over a print medium, the method of improving the printing speed also includes a bidirectional printing that performs printing not just during a scan in one direction, for example a forward scan, but also during a backward scan. The bidirectional printing is characterized in that an energy required to produce the same throughput is more distributed over time than a unidirectional printing, and thus is advantageous in terms of cost as a total system.

The bidirectional printing, however, has a fundamental problem that since an order in which color inks land on the print medium differs between the forward scan and the backward scan depending on the construction of the print heads, the overlapping order of color inks also differs, resulting in band-like color variations. This problem stems from the order in which color inks are ejected, so if different color dots overlap each other at all, this problem will emerge more or less in the form of a color difference. When a colorant, such as pigment or dye ink, is ejected onto a print medium to form an image, ink dots, after they have landed on the print medium, soak into portions of the print medium ranging from a surface layer to an interior of the medium. Next, when an ink to form subsequent dots is ejected to overlie at least partially the preceding dots on the print medium, a large part of the subsequently ejected ink penetrates and fixes below those portions already colored by the preceding ink dots. As a result, the color of the preceding ink dots tends to show more strongly than the color of the subsequently applied ink. For this reason, in a printing apparatus in which ejection nozzles of different colors are arranged in the main scan direction, performing the bidirectional printing results in band-like color variations because a color ink ejection order during the backward scan is reverse to that during the forward scan. This phenomenon similarly occurs not only with inks but also with wax-based colorants used to produce process colors because of the inverted order of color ink ejection, although there are different working principles behind the phenomenon for different types of colorants.

To solve this problem, the following methods have been proposed. In a first method, two sets of print heads for applying cyan (C), magenta (M) and yellow (Y) inks are arranged symmetrically with respect to the scan direction so that a plurality of secondary color pixels formed along a raster direction have different orders of ink application. Because a plurality of secondary color pixels arranged in the raster direction have different orders of ink application, color variations can be reduced by uniformly distributing image data between the paired, symmetrically arranged print heads to make dots with different ink application orders occur at a constant probability, whether the pixels are formed during the forward scan or the backward scan. Since the image data is allocated uniformly to the paired print heads, there are no impartial concentrations of the number of heating (ejection) operations, i.e., the load on heaters in the print heads can be spread between the print heads.

As an embodiment implementing this method, a technique has been proposed which shifts the paired print heads one-half pitch from each other in the sub-scan direction. With this technique, particularly in a low-pass printing in which color variations easily show up, it is possible to reduce the number of printing (driving) frequency of the print heads and, when a predetermined number of dots are to be arranged in one pixel, arrange these dots in a diagonal positional relation that offers an efficient dot coverage rate.

A second method proposes to perform a multipass printing using the paired, symmetric print heads described above. With this method, complementary masks used in dividing the print data are uniformly allocated to the forward and backward scans to reduce color variations even in the multipass printing.

In the conventional methods that use two sets of print heads symmetrically arranged in the main scan direction and which shifts the paired print heads one-half pitch from each other in the sub-scan direction and distributes the print data uniformly to the paired print heads, the spread processing is performed to distribute the print data to nozzle columns of interest to equalize a probability of dot formation among secondary color pixels arranged in the raster direction. This spread processing, however, may cause unwanted fine textures due to dot arrangement interferences.

These textures easily show mainly on print media with a low bleeding rate, particularly on high quality image printing media with an ink receiving layer on the surface. In a low- to mid-tone range, the textures give a granular impression, degrading an image quality significantly.

SUMMARY OF THE INVENTION

The present invention has been accomplished to overcome the aforementioned problems experienced with the conventional methods. In an ink jet printing apparatus using a so-called multipass printing mode in which an image is formed by main-scanning different nozzle groups or nozzle columns over the same scan area a plurality of times, it is an object of this invention to provide an ink jet printing apparatus and an ink jet printing method which can reduce color variations resulting from alternating scan directions and a granular impression called texture produced in a low- to mid-tone range due to the dot arrangement interferences even if a bidirectional printing is performed.

According to one aspect, the present invention provides an ink jet printing apparatus for printing a color image by using a print head having a plurality of arrayed print elements, by scanning the print head over one and the same scan area a plurality of times and by applying a plurality of color inks from the print elements to a print medium in both forward and backward directions of the scan; the ink jet printing apparatus comprising: the print head having, for each ink color, two print element array portions, each having a plurality of print elements arrayed at a predetermined interval, the print elements in one of the two print element array portions being arranged symmetric to the print elements of the other print element array portion with respect to the scan direction of the print head, the print elements in one of the two print element array portions being shifted one-half the predetermined interval from the print elements of the other print element array portion in a direction of array of the print elements; a spread pattern to arrange secondary color pixel data uniformly in a raster direction; a data spreading means to generate the pixel data according to the spread pattern; and a spread pattern changing means to change the spread pattern used by the spreading means according to a state of print data.

According to another aspect, the present invention provides an ink jet printing apparatus for printing a color image by using a print head having a plurality of arrayed print elements, by scanning the print head over one and the same scan area a plurality of times and by applying a plurality of color inks from the print elements to a print medium in both forward and backward directions of the scan; the ink jet printing apparatus comprising: the print head having, for each ink color, two print element array portions, each having a plurality of print elements arrayed at a predetermined interval, the print elements in one of the two print element array portions being arranged symmetric to the print elements of the other print element array portion with respect to the scan direction of the print head, the print elements in one of the two print element array portions being shifted one-half the predetermined interval from the print elements of the other print element array portion in a direction of array of the print elements; a spread pattern to arrange secondary color pixel data uniformly in a raster direction; a data spreading means to generate the pixel data according to the spread pattern; a spread pattern changing means to change the spread pattern used by the spreading means according to a state of print data; and a mask means to mask some of the pixel data generated by the spreading means which correspond to a column located at a predetermined position in the raster direction.

According to still another aspect, the present invention provides an ink jet printing method using an ink jet printing apparatus, wherein the ink jet printing apparatus prints a color image by using a print head having a plurality of arrayed print elements, by scanning the print head over one and the same scan area a plurality of times and by applying a plurality of color inks from the print elements to a print medium in both forward and backward directions of the scan, wherein the print head has, for each ink color, two print element array portions, each having a plurality of print elements arrayed at a predetermined interval, the print elements in one of the two print element array portions being arranged symmetric to the print elements of the other print element array portion with respect to the scan direction of the print head, the print elements in one of the two print element array portions being shifted one-half the predetermined interval from the print elements of the other print element array portion in a direction of array of the print elements; the ink jet printing method comprising: a data spreading step to generate pixel data by using a spread pattern, the spread pattern being used to arrange secondary color pixel data uniformly in a raster direction; and a spread pattern changing step to change the spread pattern used in the spreading step according to a state of print data.

With the above construction, in pixel areas of process colors including secondary colors, the spread pattern is changed according to the state of the print data, so that an image formed has dots of secondary colors evenly distributed. This in turn helps prevent color variations and reduce textures that would otherwise occur in a half-tone range.

In this specification the word "print medium" refers not only to paper used in general printing apparatus but also to a wide range of media that can receive ink, such as cloth, plastic films and metal plates. The word "Ink" refers to any liquid that is applied to the print media to form images, designs and patterns or to process the print media. Further, the "pixel area" refers to a minimum area which is applied with one or more inks to produce primary or secondary colors. The pixel area includes not only pixels but also superpixels and subpixels. The number of times that the pixel areas need to be scanned for completion is not limited to once but may be two or more times. Further, the "process color" includes secondary colors and means those colors which are produced by mixing three or more color inks on a print medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
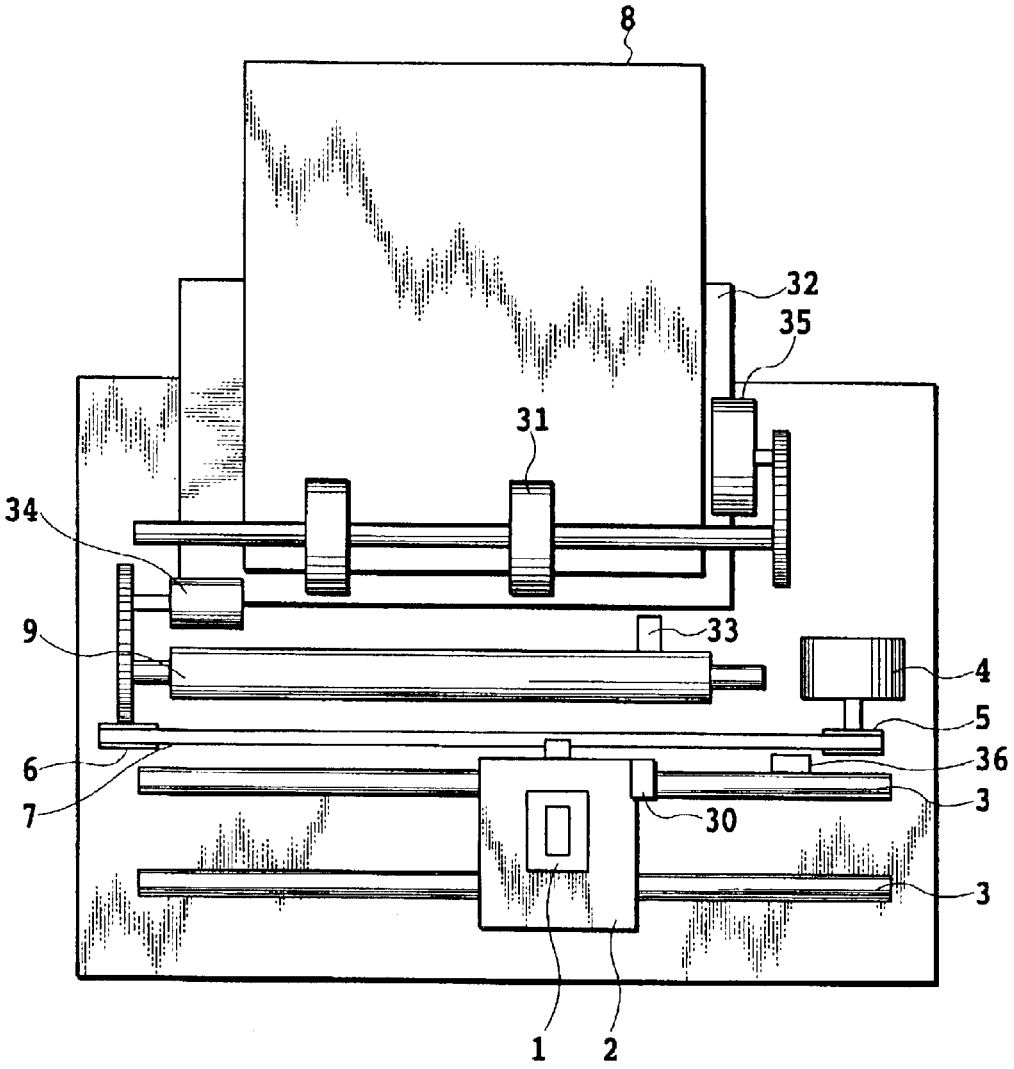
FIG. 1 is a schematic diagram showing a main mechanism in an ink jet printing apparatus.

The present invention will be described in conjunction with a preferred embodiment by referring to the accompanying drawings.

The embodiment of this invention has a control means which ensures that, in at least those pixels applied with a combination of different color dots, dot positions which produce different colors in forward and backward scans due to different ink application orders are printed at almost equal probabilities.

A printing apparatus that implements this philosophy preferably has a construction in which printing elements for different color inks are arranged in the main scan direction to form pixels. In this construction, it is also preferred that a bidirectional multipass printing be performed by using symmetrically arranged print heads capable of bidirectional printing or print heads that have print elements for different color inks arranged in the main scan direction. But other constructions may be used as long as they can realize the spirit of this invention.

The above construction is effective in a low- to mid-tone range of color images. In high-density areas the following arrangement is effective. That is, of the color inks used in one pixel, at least one color is produced by a plurality of dots of the same color, and when a secondary or higher-order color is to be produced, color dots are applied in symmetric orders.

The symmetric print heads mentioned above capable of a bidirectional printing have a construction in which, as shown in FIG. 3, two nozzle columns are provided for each color and in which these two sets of different color nozzle columns are symmetrically arranged at least with respect to the main scan direction. The symmetric print heads with this construction can eject color inks from different color nozzles onto the print medium so that the color ink application orders are symmetric among a plurality of rasters of each pixel.

When printing is done using the print heads of the above construction to produce process colors including secondary colors on a plurality of rasters of each pixel, the pixel is applied with a plurality of dots of different primary color inks which, when seen in the main scan direction, are arranged in symmetric positions or applied in symmetric orders in the forward and backward scans. This arrangement can eliminate various problems experienced with the conventional methods, including assimilations with geometric data such as horizontal lines and color differences occurring in high-density areas due to an ink application order change. Further, color variations that occur during a bidirectional printing due to assimilation with half-toning, such as dithering, in a mid-tone to low-density range can be alleviated by the provision of a control means. For those pixels that are formed with at least a combination of different color dots, this control means ensures that the color ink application orders that are opposite in the forward and backward scans have almost equal probabilities of occurrence.

Now, an embodiment of the present invention will be described in detail by referring to the accompanying drawing. In each figure, elements with like reference symbols represent identical or corresponding elements.

FIG. 1 is a schematic diagram showing a basic construction of a main mechanism in the ink jet printing apparatus applying the present invention.

Denoted 1 are head cartridges each having a print head and an ink tank integrally assembled together. The head cartridges 1 are replaceably mounted on a carriage 2. In addition to the print head made up of a plurality of nozzles and the ink tank for supplying ink to the print head, the head cartridge 1 has a connector for transferring signals to drive nozzles of the print head. The head cartridges 1 are positioned and replaceably mounted on the carriage 2, which has a connector holder to transfer drive signals to the head cartridges 1 through the connector.

Designated 3 are guide shafts that extend along the width of the printing apparatus body. The carriage 2 is reciprocally movable along the guide shafts 3. More specifically, the carriage 2 is driven by a main scan motor 4 through a drive mechanism including a motor pulley 5, a follower pulley 6 and a timing belt 7. The position and movement of the carriage 2 are also controlled by them. A home position sensor 30 is provided on the carriage 2 so that it can detect its position when it passes a shield plate 36 attached to one of the guide shafts 3. A movement of the carriage along the guide shafts 3 is called a "main scan" and a direction of this movement is called a "main scan direction."

Print media 8, such as print paper and plastic thin sheets, are stacked in an auto sheet feeder (ASF) 32. During a printing operation, a paper supply motor 35 is driven to rotate a pickup roller 31 through gears to separate and feed one sheet at a time from the auto sheet feeder 32. Further, a rotation of a transport roller 9 feeds the print medium to a print start position where it faces nozzle surfaces of the head cartridges 1 on the carriage 2. The transport roller 9 is driven by a LF motor 34 through gears. A decision on whether the print medium has been supplied and a determination of a front end position of the print medium during the paper supply operation are made when the print medium 8 passes a paper end sensor 33. Further, the paper end sensor 33 is also used to find where a rear end of the print medium 8 actually is and to determine the present printing position from the actual rear end.

The print medium 8 is supported at its back by a platen (not shown) to form a planar print surface where the printing is performed. The head cartridges 1 mounted on the carriage 2 are held between the two guide shafts so that the nozzle surfaces of the head cartridges 1 protrude down from the carriage 2 and are parallel to the print medium 8.

The printing operation is carried out as follows. First, when the print medium 8 is fed to the predetermined print start position, the carriage 2 is moved over the print medium 8 along the guide shafts 3 while at the same time the print heads eject inks. When the carriage 2 has reached one end of the guide shafts 3, the transport roller 9 feeds the print medium 8 a predetermined distance in a direction perpendicular to the scan direction of the carriage 2 (this is called a "feeding" or "sub-scan", and a direction of this feeding is called a "feeding direction" or "sub-scan direction"). After the print medium 8 has been fed a predetermined distance, the carriage 2 is again moved along the guide shafts 3. By repeating the scan of the print heads and the feeding operation, an image is formed over an entire surface of the print medium 8. In this embodiment, if the print heads perform printing during the scan of the carriage 2 in both directions, i.e., in a forward direction and a backward direction, this printing mode is called a "bidirectional printing."

Each of the print heads of the head cartridges 1 in this embodiment has a plurality of nozzles arranged in a column in the sub-scan direction. In each nozzle an ejection heater or electrothermal transducer is installed. During printing, a thermal energy of the ejection heater is used to generate a bubble in ink in the nozzle to expel an ink droplet of a predetermined volume by a pressure of the bubble as it grows. While this embodiment employs a bubble jet type ink jet head, other types may be used, such as a piezo type that ejects ink by piezoelectric elements.

Figure 2:
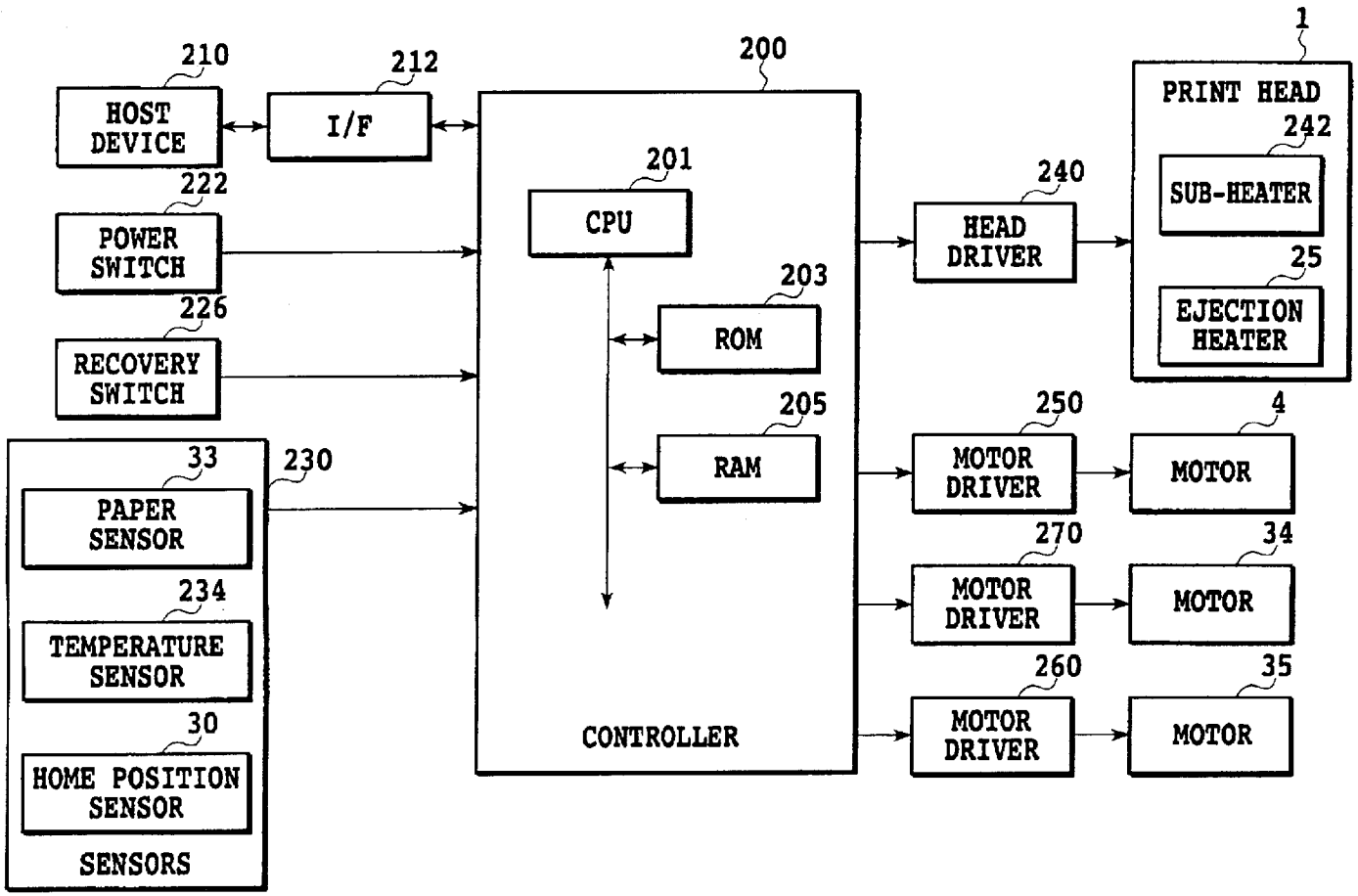
FIG. 2 is a block diagram of a control circuit in the ink jet printing apparatus.

FIG. 2 is a block diagram showing a rough configuration of a control circuit used in the ink jet printing apparatus described above.

In the figure, a controller 200 is a main control unit, which has a CPU 201 in the form of a micro computer, a ROM 203 storing programs, tables and other fixed data, and a RAM 205 having an image data mapping area and a work area. A host device 210 is an image data source (in the form of a computer which generates and processes data such as images to be printed, or an image reader). Image data and command and status signals are transferred through an interface (I/F) 212 to and from the controller 200.

An operation unit 120 has switches for accepting command inputs from an operator and includes a power switch 222 and a recovery switch 226 for activating a suction-driven recovery operation. A group of sensors 230 are to detect the state of the apparatus and includes the home position sensor 30 described earlier, a page end sensor 33 for detecting the presence or absence of the print medium, and a temperature sensor 234 installed at an appropriate location to detect an ambient temperature. A head driver 240 drives ejection heaters 25 in the print head according to print data. The head driver 240 includes a shift register for aligning print data to the corresponding positions of the ejection heaters 25, a latch circuit for latching at an appropriate timing, logic circuit elements for energizing the ejection heaters in synchronism with drive timing signals, and a timing setting unit for properly setting a drive timing (ejection timing) for aligning dot formation positions. The print head 1 has sub-heaters 242. The sub-heaters 242 are used for temperature adjustment to stabilize an ink ejection characteristic. The sub-heaters 242 may be formed on a print head substrate simultaneously with the ejection heaters 25 and/or attached to the print head body or head cartridge.

A motor driver 250 is a driver to drive the main scan motor 4. The sub-scan motor 34 is a motor to feed the print medium 8 in the sub-scan direction and is driven by a motor driver 270.

The line feed motor 35 separates and feeds the print medium 8 from the ASF and is driven by a motor driver 260.

Figure 3B:
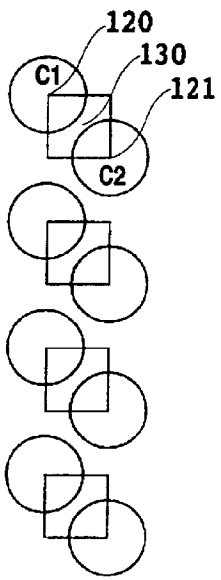
FIG. 3B is a diagram showing how dots are produced for individual pixels by the print heads.
Figure 3A:
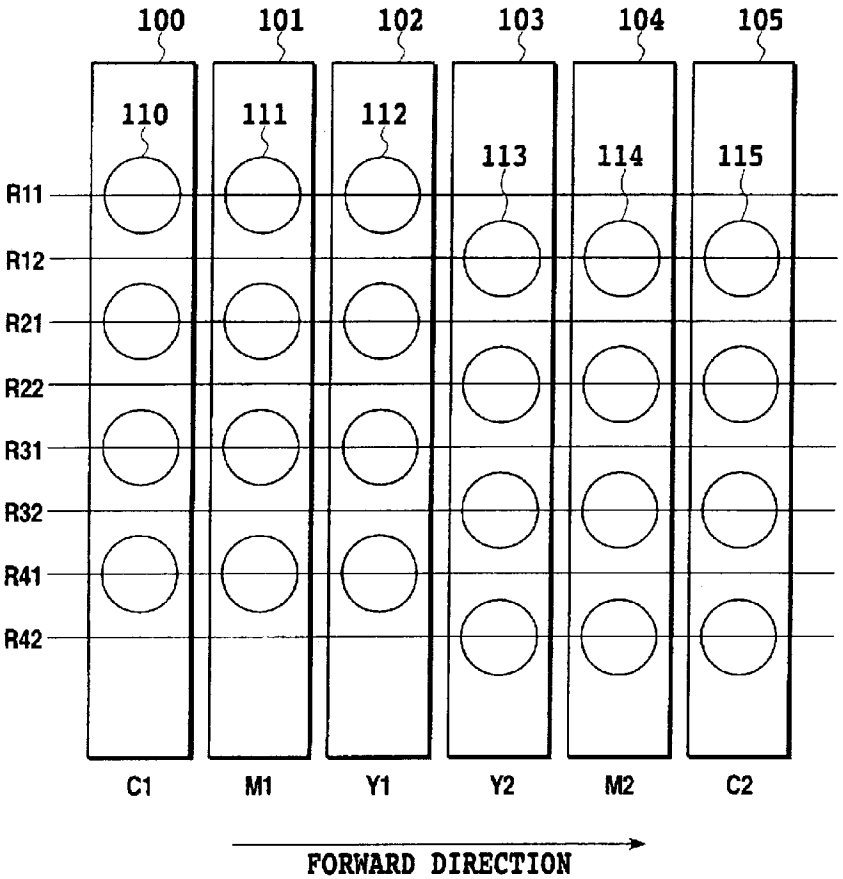
FIG. 3A is a schematic diagram showing a main part of print heads.

FIG. 3A is a schematic diagram showing an essential part of a first basic construction of print heads of the head cartridges 1. In the figure, denoted 100 is a first print head (C1) for ejecting a cyan ink, 101 a first print head (M1) for ejecting a magenta ink, and 102 a first print head (Y1) for ejecting a yellow ink. Designated 103 is a second print head (Y2) for ejecting a yellow ink, 104 a second print head (M2) for ejecting a magenta ink, and 105 a second print head (C2) for ejecting a cyan ink. These print heads are arranged in the order described above in a forward direction of the main scan. These heads are also referred to simply as C1, M1, Y1, Y2, M2 and C2. Each of these print heads has nozzles arranged in column at a predetermined interval, which is referred to as a pitch or nozzle pitch in the following explanation. Two print heads in each pair of the same color are staggered one-half nozzle pitch from each other in the sub-scan direction. This arrangement is made to minimize dot overlapping and increase a dot coverage when printing at a maximum density. Although this diagram does not show black print heads, the black print heads may also be added to this construction.

The nozzles are also referred to as print elements and the nozzle columns as print element columns.

In each head cartridge 1, the print head has a plurality of ejection nozzles. For example, the print head 100C1 has cyan ejection nozzles 110, the print head 101M1 has magenta ejection nozzles 111, the print head 104M2 has magenta ejection nozzles 114, and the print head 105C2 has cyan ejection nozzles 115.

The nozzles in each print head are arrayed in a direction almost perpendicular to the main scan direction. Strictly speaking, they may be arranged more or less inclined to the main scan direction because of ejection timings. Further, the print heads are arranged in the same direction as the main scan direction. More specifically, in the case of FIG. 3A, the print heads 100C1, 101M1, 102Y1, 103Y2, 104M2, 105C2 are arranged in the same direction as the main scan direction.

FIG. 3B shows a result of printing a primary color of cyan. To produce a mid-density at a pixel 130, two dots are formed as a pair at a dot position 120 and a dot position 121. In the figure, the dot position 120 and the dot position 121 represent positions of the dots ejected to a pixel 130 from the nozzle 110 of the print head 100C1 and from the nozzle 115 of the print head 105C2. The dot position 120 assumes an upper left corner of the pixel 130 and the dot position 121 assumes a lower right corner. R11 and R12 represent main scan lines or rasters along which the pixels 130 are formed. Here, two rasters are used to form single pixels. In FIG. 3A, an arrow indicates a direction of forward scan of the heads. During the forward scan, the inks are applied to the pixel 130 first from the print head 105C2 followed by the print head 100C1. During the backward scan, the printing order is C1 followed by C2. In the case of the primary colors, however, since the ink droplets applied to the pixel are of the same color, the ink application order does not produce any difference in color. In the figure, although the dots at position 120 and position 121 are shown not overlapping, in practice they normally partly overlap each other on the print medium.

Various colors on a color image are produced by combinations of three colors, cyan, magenta and yellow. Thus, there are cases where a plurality of color inks land on the same pixel. FIG. 3A and FIG. 3B have shown a printed example of a primary color using a single color ink. Next, we will explain about a production of secondary or higher-order colors.

Figure 4B:
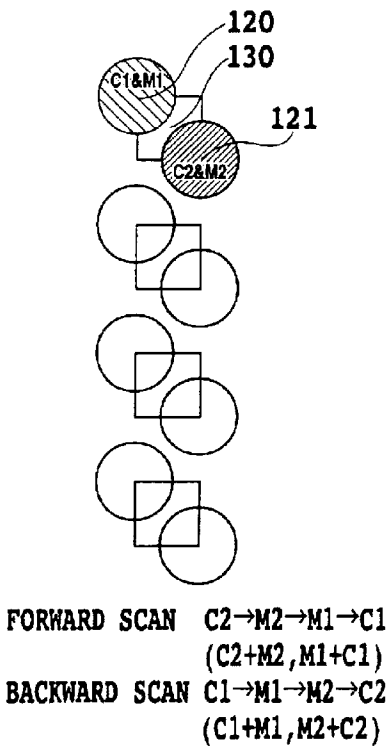
FIG. 4B is a diagram showing how dots are produced for individual pixels by the print heads.
Figure 4A:
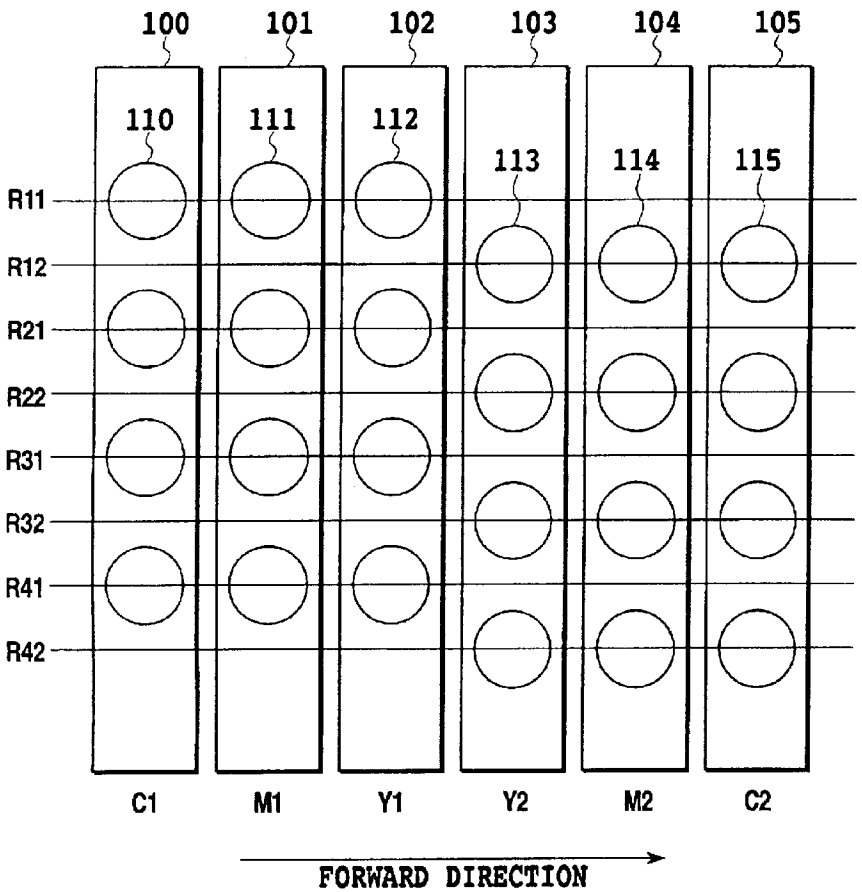
FIG. 4A is a schematic diagram showing a main part of print heads.

By referring to FIGS. 4A and 4B, we will describe a basic construction of a main part of the print heads and a result of printing multiple color inks on one pixel. FIG. 4A shows print heads of the same construction as FIG. 3A. These print heads are used to apply a cyan ink and a magenta ink to each of the pixels 130.

At each of the dot positions 120, 121 in FIG. 4B, cyan and magenta dots are applied one upon the other. Unlike the structure of the pixel 130 shown in FIG. 3B, the pixel of FIG. 4B has a dot-on-dot structure in which different color dots completely overlap each other at each dot position.

For example, when a blue is to be produced as a secondary color, a cyan ink and a magenta ink are used. Let us consider the dot position 121. In the forward scan, a cyan dot from the nozzle 115 of the print head 105C2 lands first on the print medium, followed by a magenta dot from the nozzle 114 of the print head 104M2. This dot will produce a color of bluish purple, in which the cyan that was first applied normally dominates according to the principle described earlier.

Similarly, let us look at the dot position 120. In the forward scan, a magenta dot from the nozzle 111 of the print head 101M1 lands first on the print medium, followed by a cyan dot from the nozzle 110 of the print head 100C1. This dot will produce a color of reddish purple, in which the magenta that was first applied normally dominates according to the principle described earlier.

Now, the printing process during a backward scan is examined. A cyan dot from the nozzle 110 of the print head 100C1 lands first on the print medium, followed by a magenta dot from the nozzle 111 of the print head 101M1. This dot position 120 appears as a bluish purple, in which the cyan that was first applied normally dominates. Likewise, at the dot position 121 during a backward scan, a magenta dot from the nozzle 114 of the print head 104M2 lands first on the print medium, followed by a cyan dot from the nozzle 115 of the print head 105C2. This dot position 121 will produce a color of reddish purple, in which the magenta that was first applied normally dominates. As described above, each pixel is always printed with a pair of a blue dot with a reddish purple tint and a blue dot with a bluish purple tint. When microscopically seen, columns of dots that have different tints alternate in the main scan direction. When each of the pixels 130 is macroscopically seen, the order of color ink application is a cyan dot from C2, a magenta dot from M2, a magenta dot from M1 and a cyan dot from C1 in the forward scan. In the backward scan, the color ink application order is a cyan dot from C1, a magenta dot from M1, a magenta dot from M2 and then a cyan dot from C2. It is seen that the pixels have symmetrical orders of color ink application in terms of the scan direction.

Therefore, a half-tone blue can be produced uniformly among pixels.

While in this example, a blue (a combination of cyan and magenta) is taken as an example, it is easily understood that the same explanation applies also to a red (magenta and yellow) and a green (cyan and yellow). Further, even when forming secondary or higher-order process colors, it will be easily understood that the similar effect can be produced if primary colors making up the process colors are applied to pixels in the symmetrical order described above.

Ejection data that drives individual nozzles of each print head 100–105 is generated by the controller 200 and the head driver 240, as described in connection with FIG. 2. When an image to be printed is a solid image, the nozzles to be driven are almost all the nozzles of each print head and no problem arises. But when producing a half-tone, not all the nozzles are used. If ejection data concentrates on particular rasters, only the associated nozzles are loaded heavily, giving rise to a durability problem. To make a nozzle use probability or a dot generation probability uniform, print data must be scattered or spread among all nozzles. In the following, the spread processing according to this invention will be explained.

Figure 5:
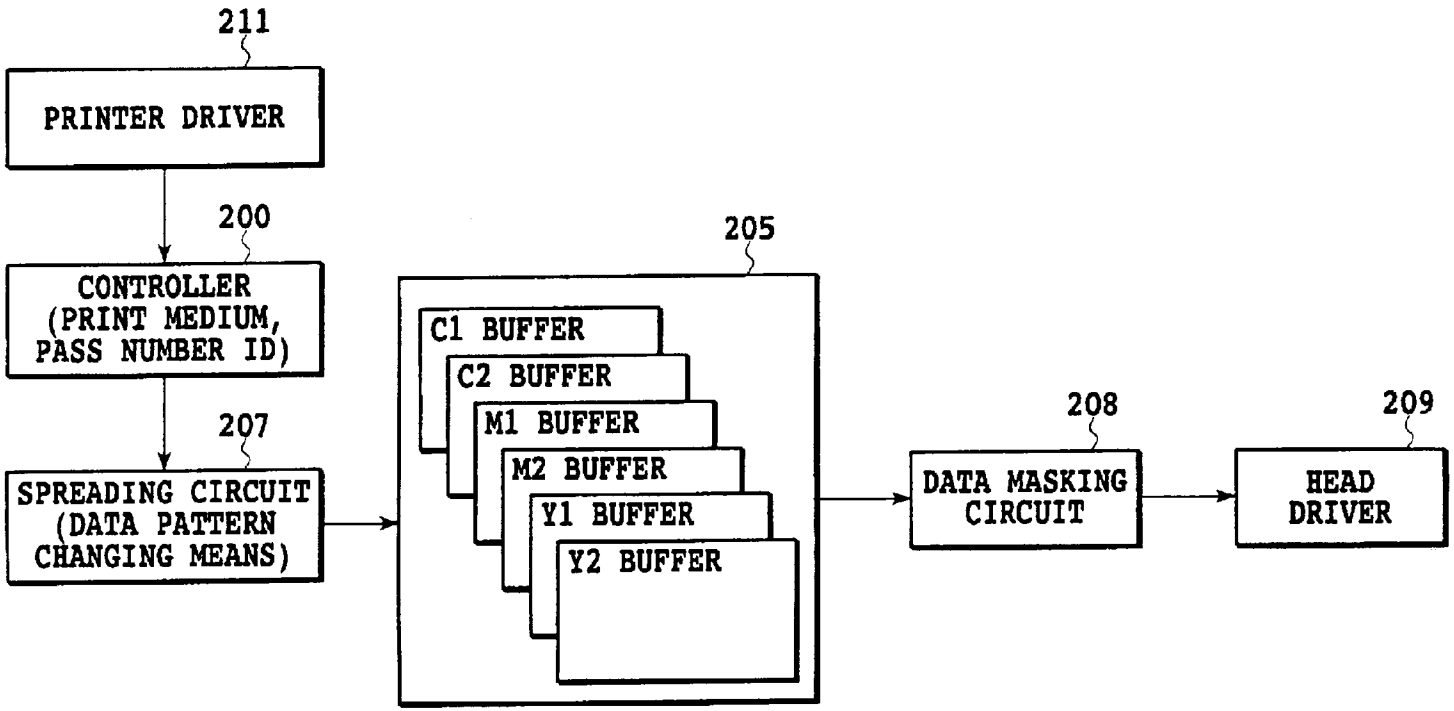
FIG. 5 is a block diagram showing a data processing path in the ink jet printing apparatus.

FIG. 5 shows a data processing path and a data buffer structure in the printing apparatus of this embodiment. In the figure, the printer driver 211 corresponds to a program in the host device 210 of FIG. 2 that generates image data and transfers the generated data to the printing apparatus. The controller 200 maps the RGB 8-bit image data supplied from the printer driver 211 as required and converts it into CMY 2-bit data. For uniform dot generation probability, the CMY 2-bit data is sent to a spread circuit 207 where it undergoes the spread processing. The detail of the spread processing will be described later but a rough configuration of the spread circuit 207 is as follows. The spread circuit 207 writes data of CMY colors into print buffers 205 according to correspondence tables shown in FIGS. 6A, 6B and 6C described later. Suppose, for example, 2-bit data is to be written for cyan. In this embodiment, for a maximum density, two bits are written into each of buffers 205C1, 205C2 for the print heads 100C1, 105C2. When these print heads reach predetermined positions in pixels where they are supposed to perform printing, the data on the associated buffers are read into the registers in the print heads for printing. With this data and buffer configuration, it is possible to print on subpixels using single dots, 2-dot combinations and 4-dot combinations from different print heads. Although CMY colors are used here, the above explanation also applies similarly to other cases where CMYK colors, dark and light inks, or other color inks are used. The print buffers 205C1, C2, M1, M2, Y1, Y2 are provided in the RAM205.

Then, the print data mapped in the print buffer is masked by a masking circuit 208 for multipass printing and then transferred to the head driver 209.

Next, dot spread patterns in the spread circuit will be explained in detail.

In this embodiment, a configuration will be described which generates 2-bit 4-value ejection data (corresponding to the number of dots, 0, 1, 2, and 4) for each color according to the density of each pixel. The number of bits is not limited to two bits but multiple bits such as four bits may be employed. Further, even in the two-bit data format, only a particular nth value of that data format may be used. The number of bits is determined by a relation between a print resolution and a dot diameter, a gray scale level for each pixel, and a design philosophy of deciding at what level the maximum density shall be. Thus, according to the spirit of this invention, either of these bit numbers can be implemented.

There is a close relationship between a dot shape—which is determined by an ink droplet size ejected form the print head, an ink penetrability and a print medium bleed rate—and a drive frequency as well as the dot arrangement described above. In this embodiment in particular, because of the drive frequency, adjoining dots on the same raster cannot be printed in a single scan. That is, when performing a 1-pass printing, a certain limitation is imposed on the bit signal output from the spread circuit so that particular 3-value data, i.e., data of up to 2-dot combinations, are allowed for use in printing. During a multipass printing, in each of subdivided data masks whose total number matches the number of passes, a limitation may be introduced to prevent dots on the same raster from being arranged at adjoining positions. This enables the normal printing of 4-value data, including a 4-dot combination data which corresponds to the maximum density.

In this embodiment, for print media having an ink receiving layer with a low bleed rate, two dots per pixel represents too low a maximum density, so a multipass printing is performed.

For print media with a high bleed rate, such as plain paper, a texture is not likely to show up in a low- to mid-tone range which is considered to be a problematic range in this embodiment.

Suppose, for example, that a maximum number of dots of the same color to be applied to each pixel is four dots. The 4-dot combination represents the maximum density and, from the standpoint of the drive frequency, is completed in multiple scans. Since the maximum density is produced by a 4-dot combination, it is only possible to apply less than four dots to each pixel in order to produce a half-tone having a lower density. In this embodiment, for half-tone pixels that are not applied with 4-dot combinations, a single dot or a 2-dot combination is used for each color. Particularly when pixels are formed with single dots, unless the spread processing is executed, dots may concentrate on particular raters when secondary colors are reproduced in the forward and backward scans. In the symmetrically arranged print heads of this embodiment, when data concentrates on one of the two symmetric heads for each color, the drive frequency of that head increases. Although in the multipass printing the use of a data mask can alleviate color variations, an impartial driving of the paired print heads cannot be eliminated, giving rise to a problem of only one head being loaded as described above and also to a durability problem.

Figure 6A:
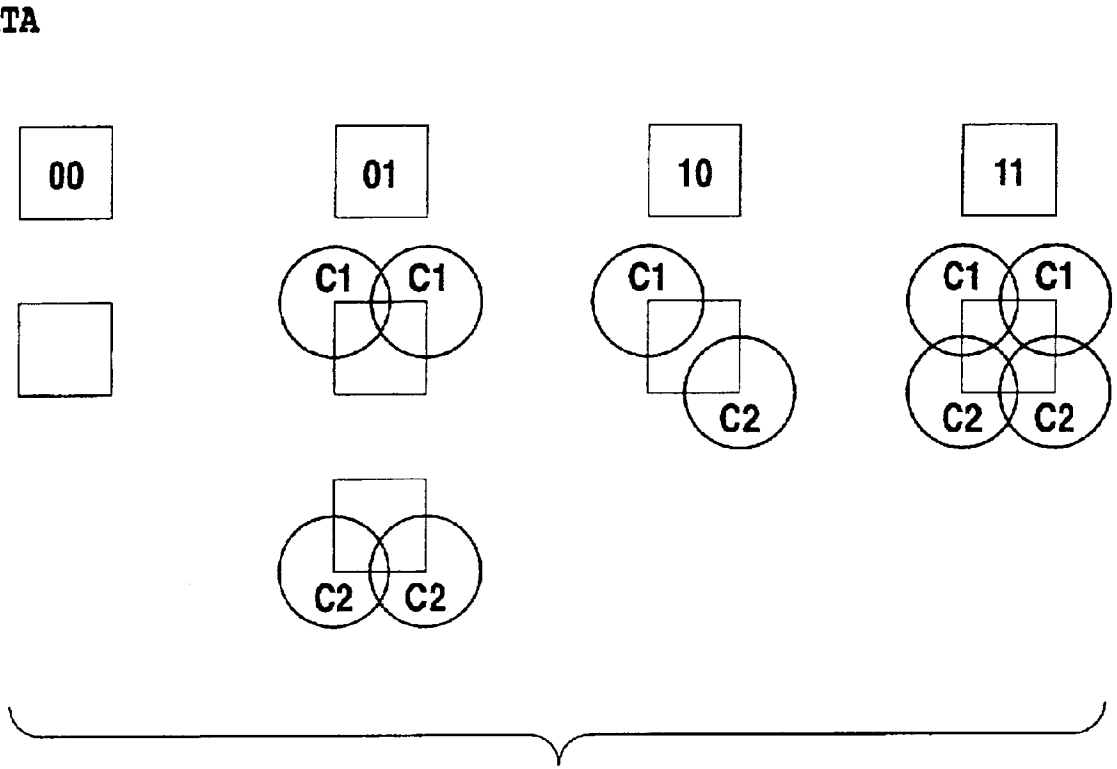
FIG. 6A is a schematic diagram showing a table specifying a cyan dot arrangement in spread processing.
Figure 6B:
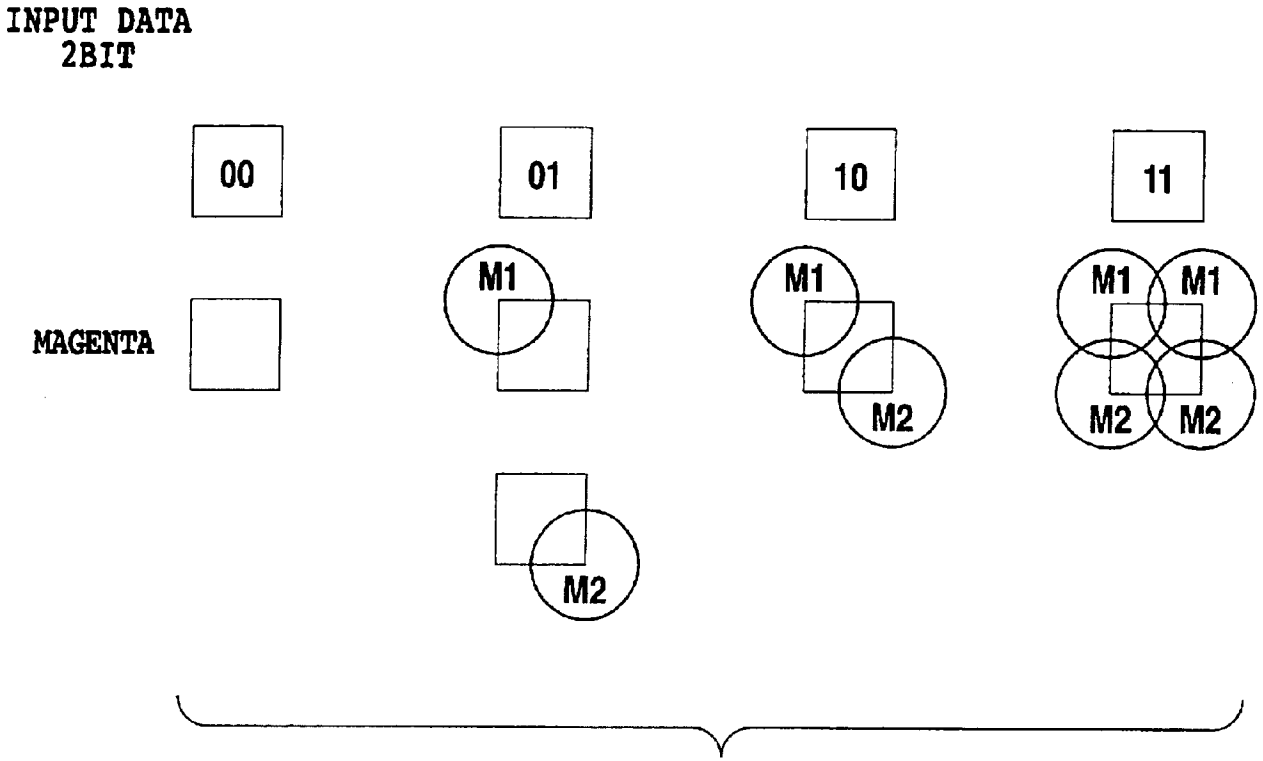
FIG. 6B is a schematic diagram showing a table specifying a magenta dot arrangement in spread processing.
Figure 6C:
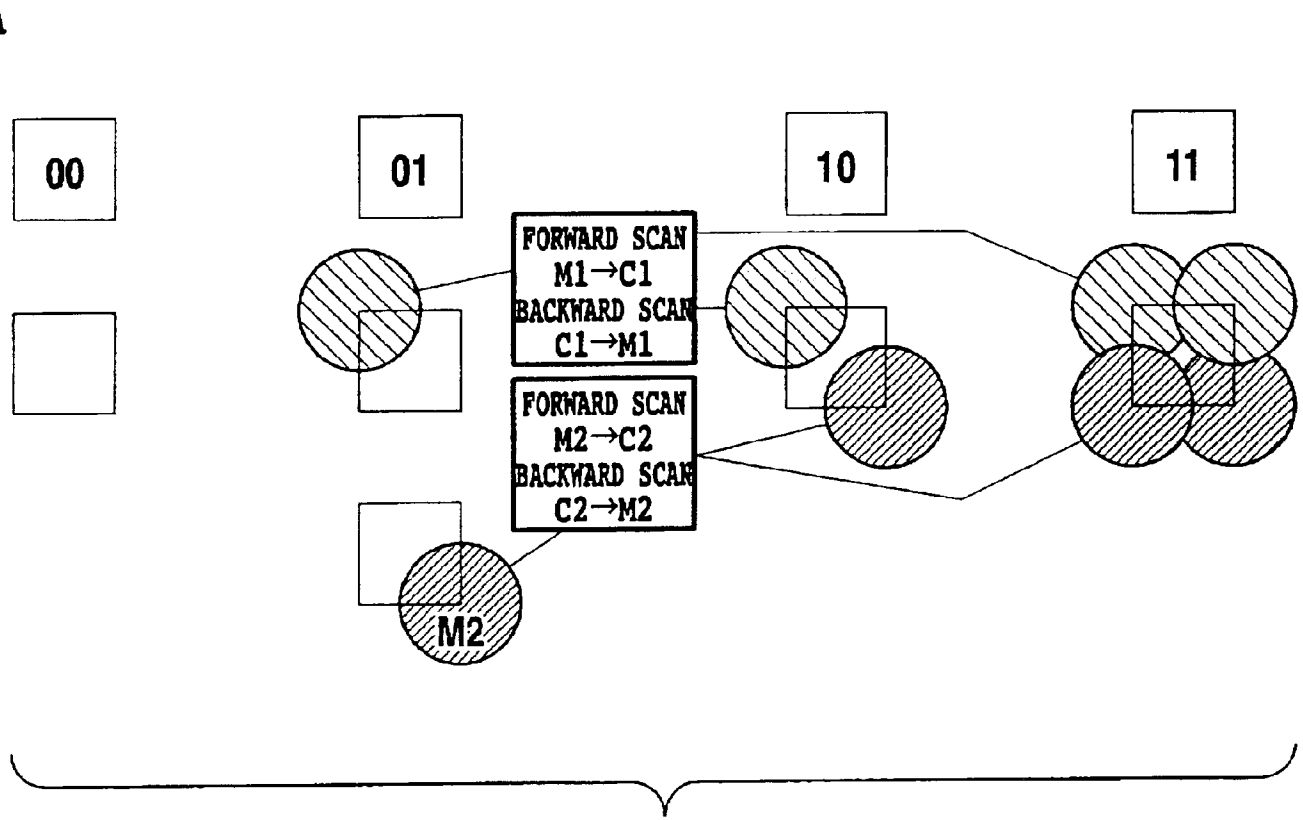
FIG. 6C is a schematic diagram showing a table specifying a blue dot arrangement in spread processing.

FIG. 6A to FIG. 6C show schematic diagrams of tables defining how dots are scattered by the spread processing and also dot arrangement patterns. In the figures, circled positions represent positions where dots are to be applied, and symbols in the circles represent print heads that print dots at these positions. The print heads correspond to those explained with reference to FIGS. 3A, 3B, 4A and 4B.

FIG. 6A show a relation between input data and dot positions for cyan. There are four kinds of input data as described above, 00, 01, 10, and 11, with 11 representing the maximum density. In the case of cyan, no dots are applied for the data 00. For the data 01, two dots are applied from the C1 head or C2 head. When the C1 head is used, data is stored in the print buffer 205C1 in FIG. 5. When the C2 head is used, data is stored in the print buffer 205C2. These data are processed by the spread circuit 207 so that a dot emerging probability is almost uniform. The dot arrangement for the data 01 is one of four positions shown at 01 in FIG. 6A. In this embodiment, the dot arrangement when viewed in the raster direction is limited to one pattern so that, when forming a secondary color as shown in FIG. 4B, the dots applied to one pixel always have a dot-on-dot relationship. That is, in dot arrangements for 01 of FIG. 6A, two patterns indicated with solid lines are made available so that the dots in each pixel are arranged diagonally. For the data 10, two dots as a pair are placed on each pixel and the corresponding data are stored in the print buffers 205C1, 205C2 of FIG. 5. The dot arrangement will be as shown in 10 of FIG. 6A. For the data 11, each pixel has four dots in combination and the corresponding data are stored in the print buffers 205C1, 205C2 of FIG. 5. The dot arrangement will be as shown at 11 of FIG. 6A.

FIG. 6B shows a relation between input data and dot positions for magenta (M). This is similar to the cyan case and its explanation is omitted.

FIG. 6C shows a relation between input data and dot positions for blue, a secondary color formed from cyan and magenta. In the case of primary colors (cyan and magenta), there no such problem as a color difference caused by a difference in the order of ink application because only one kind of ink is applied. However, in the case of secondary colors, two kinds of ink are used and thus a color difference is produced by a difference in the ink application order. Therefore, the ink application order is important. Although the input data in FIG. 6C is shown as input data for blue, FIG. 6C actually represents a case where equal levels of signals 00, 01, 10, 11 are entered to both cyan and magenta. For the input data 00, no dots are formed. For the input data 01, there are the following four cases. First, as to the print heads used, there are two combinations of print heads, a combination of magenta M1 and cyan C1 and a combination of magenta M2 and cyan C2. The M1-C1 print head combination has two possible cases in terms of ink application order: one is an ink application order of magenta M1 and cyan C1 in the forward scan and another is an ink application order of cyan C1 and magenta M1 in the backward scan. Likewise, the M2-C2 print head combination has two possible cases in terms of ink application order, i.e., an ink application order of magenta M2 and cyan C2 in the forward scan and an ink application order of cyan C2 and magenta M2 in the backward scan. With the input data 01, for each dot position obtained as a result of performing the spread processing of the spread circuit 207 on the cyan C and magenta M, respectively, there are the above-described cases. Therefore, there are a total of eight possible cases of dot arrangement in each of the forward and backward scans. Although it is possible in a simplest system to reproduce the input data 01 by using as is these eight cases of dot arrangement in each scan direction, this embodiment uses two cases of dot arrangement. This is because in this embodiment secondary colors are formed in a dot-on-dot configuration at all times and color variations are reduced by equally spreading the probability of dots being applied in different orders. This spreading (or distribution) may be achieved by distributing data to a plurality (in this case, two) of buffers sequentially (alternately) or randomly. In this spread processing, the only requirement is to prevent the order of ink application to a plurality of pixels arranged in the raster direction from becoming impartial or concentrated. It is ideal for the reason described above that dots formed in different ink application order are produced at almost equal rates.

For the input data 10, 11, there are possible cases of dot arrangement in each of the forward and backward scans. Because at each dot position on each pixel, dots are applied in the same order as that of the input data 01, the same color can be produced on the pixel. While in FIG. 6C the dot arrangement has been explained for cyan and magenta and for their secondary color, blue, the same principle applies also to yellow and other secondary colors, green and red. As described above, by spreading the data through the spreading patterns shown in FIGS. 6A–6C, it is possible to eliminate the problem of load concentration on only a particular head or nozzles.

Figure 7A:
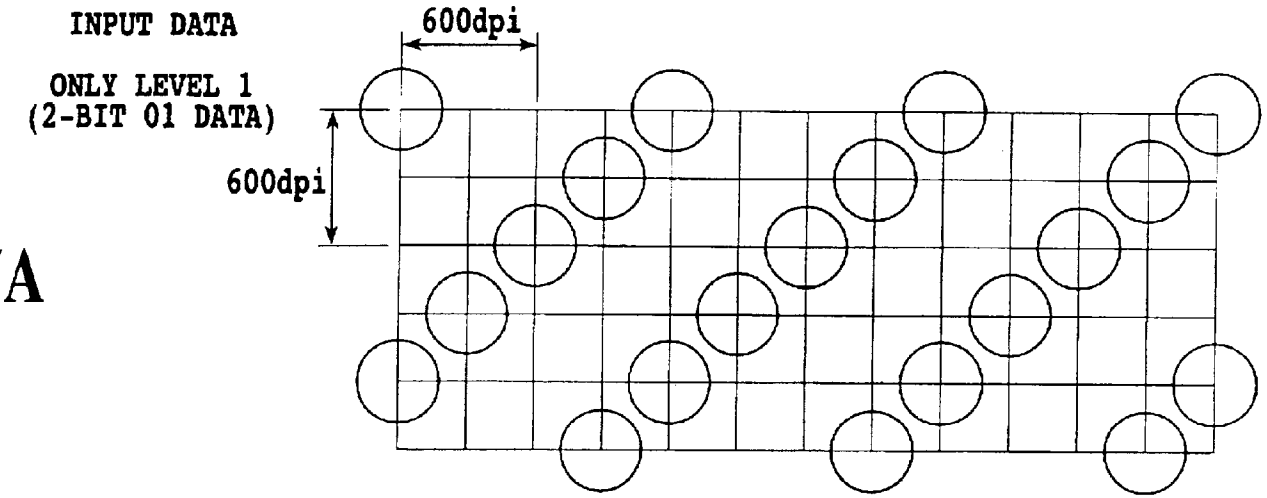
FIG. 7A is a schematic diagram showing a result of printing the spread pattern data 01 of FIG. 6A to FIG. 6C.
Figure 7B:
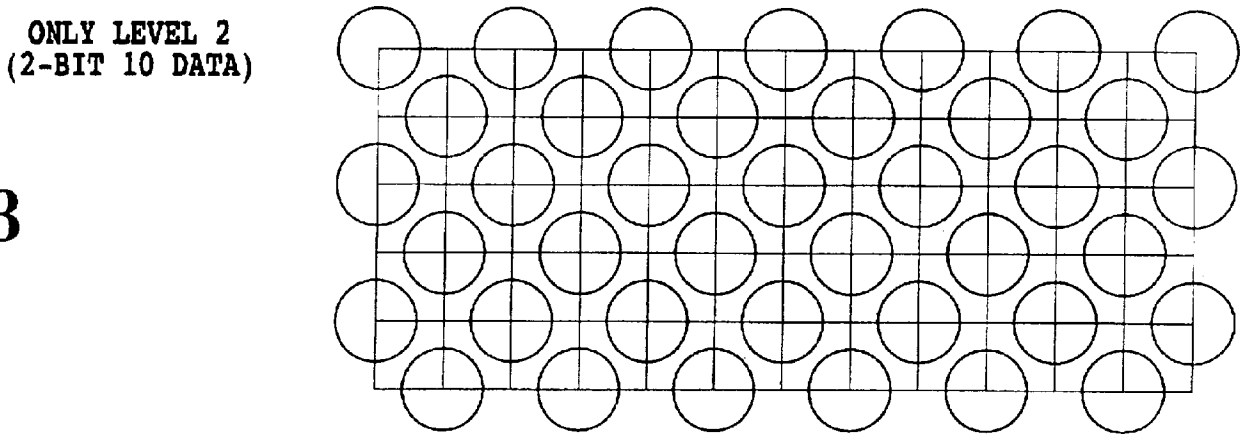
FIG. 7B is a schematic diagram showing a result of printing the spread pattern data 10 of FIG. 6A to FIG. 6C.

FIGS. 7A and 7B are diagrams showing textures produced when printing is done using the dot arrangement patterns of FIGS. 6A–6C. FIG. 7A represents a result of printing only the input data 01 and FIG. 7B represents a result of printing only the input data 10. As described above, the data 01 is spread by the spread circuit to reduce color variations. In this embodiment, the presence or absence of dots is detected and the data is spread sequentially. The input data 01 produces an oblique, alternate arrangement of relatively large spaces with no dots and closely dotted areas. When seen macroscopically, the printed dots show an oblique texture, which looks hardly homogeneous. When this dot arrangement occurs even partly on photographic images, this gives granular impression. Conversely, with the input data 10, printed dots are uniformly distributed and appear homogeneous.

In half-tones where such a texture problem arises, this invention performs the spread processing by using other spread patterns than those shown in FIG. 6A to FIG. 6C to eliminate the texture problems.

In FIGS. 6A–6C, an example has been explained in which data is arranged diagonally on a pixel. Other data arrangements are also possible, which include a "vertical arrangement" in which data is arranged in a direction of nozzle array or nozzle column, a "horizontal arrangement" in which data is arranged in the scan direction, and an "overlapping arrangement" in which data is arranged at overlapping positions. In the following, we will explain about these arrangements and effective arrangements for half-tones.

Figure 8A:
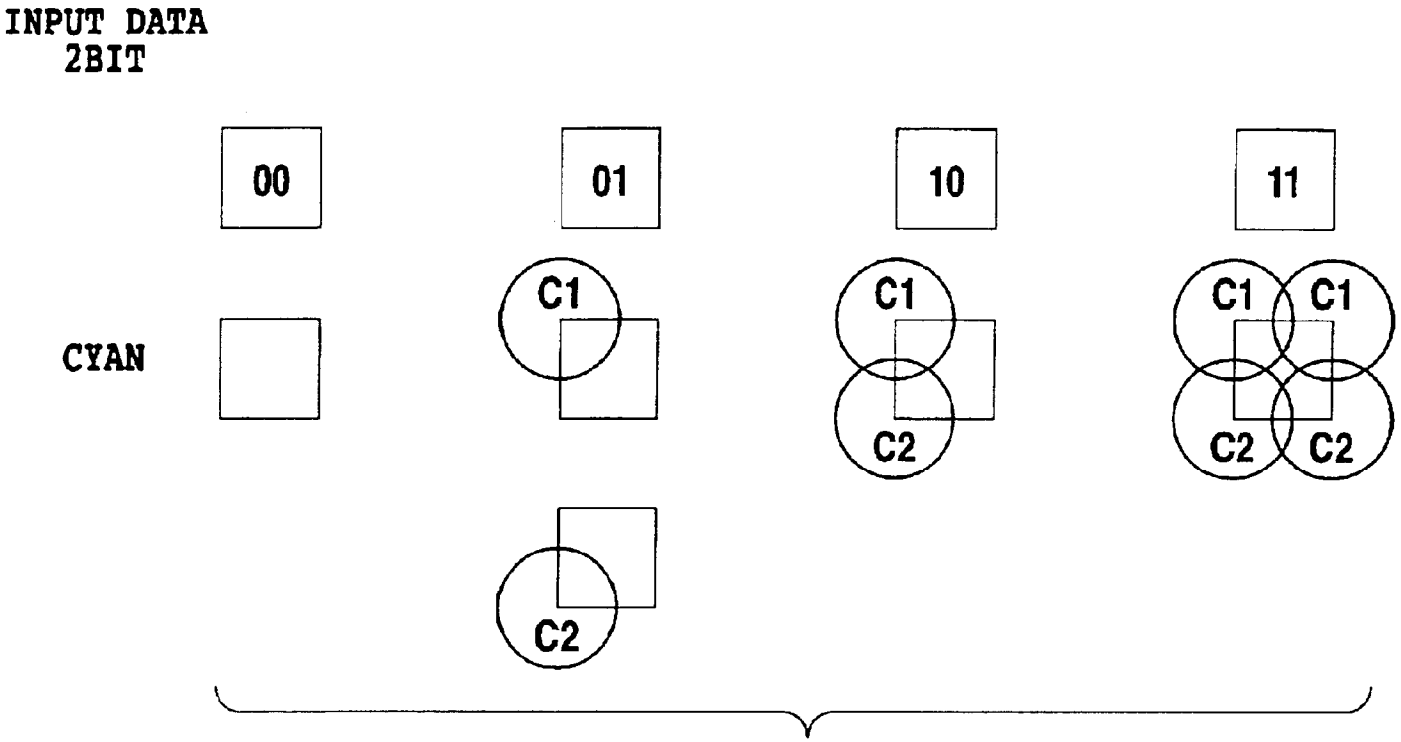
FIG. 8A is a schematic diagram showing a table specifying a cyan dot vertical arrangement.
Figure 8B:
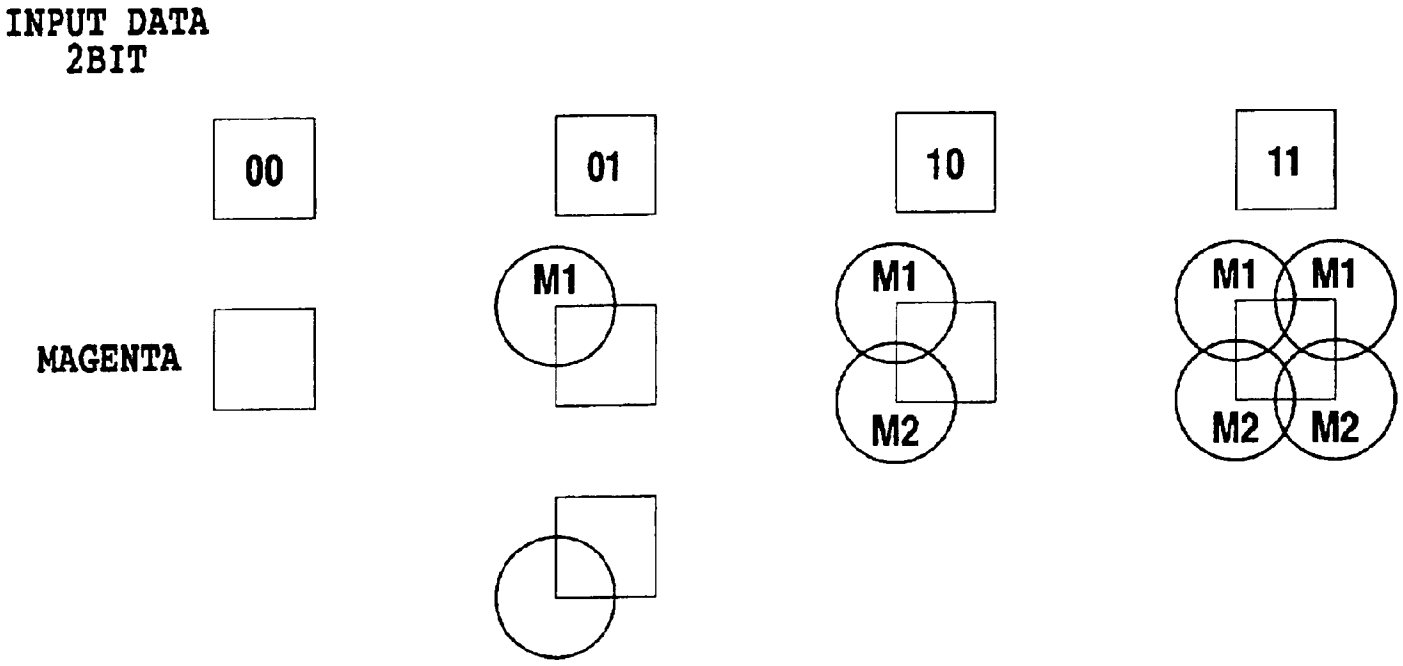
FIG. 8B is a schematic diagram showing a table specifying a magenta dot vertical arrangement.
Figure 8C:
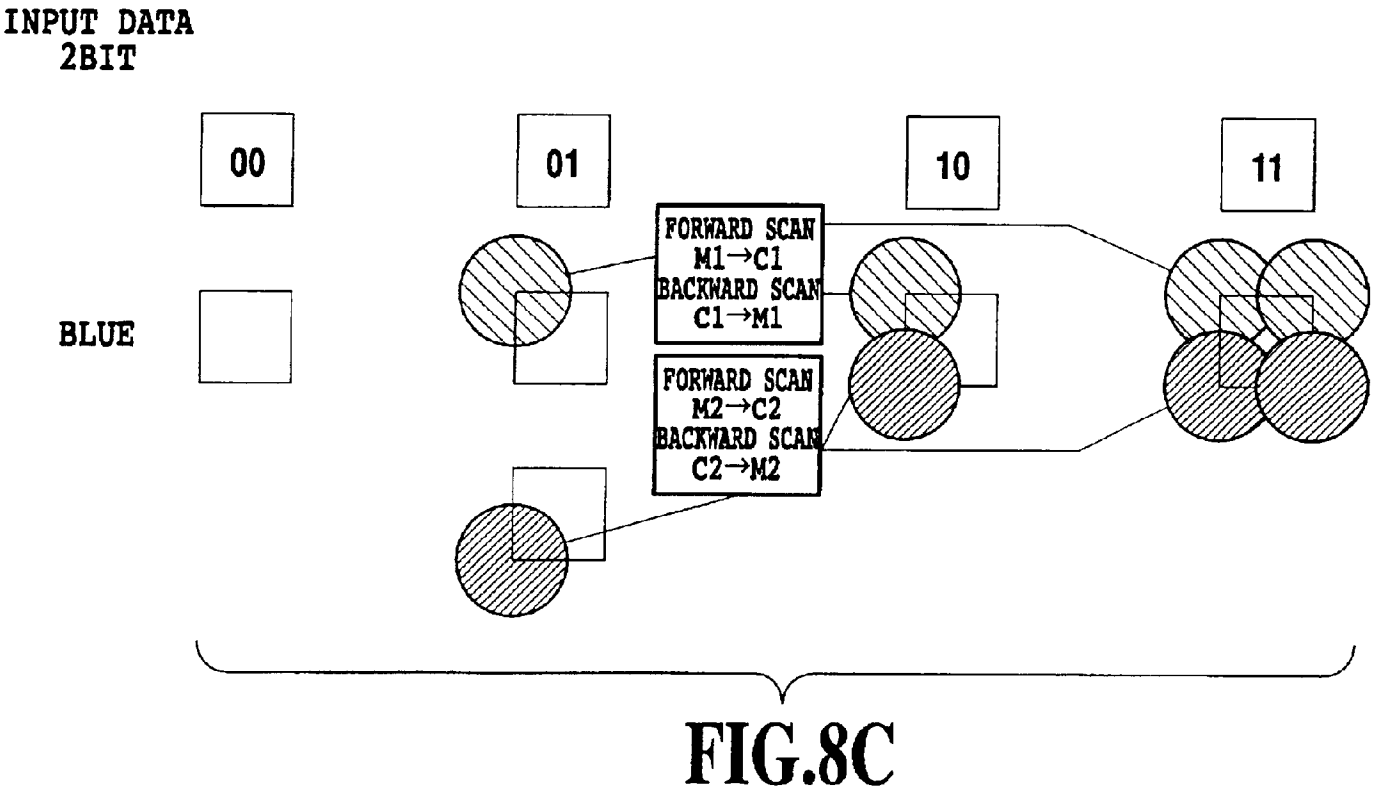
FIG. 8C is a schematic diagram showing a table specifying a blue dot vertical arrangement.

FIGS. 8A–8C show the input data 01 and the input data 10 each arranged vertically on a pixel. In this arrangement, too, the spread processing is performed to alleviate color variations.

Figure 9A:
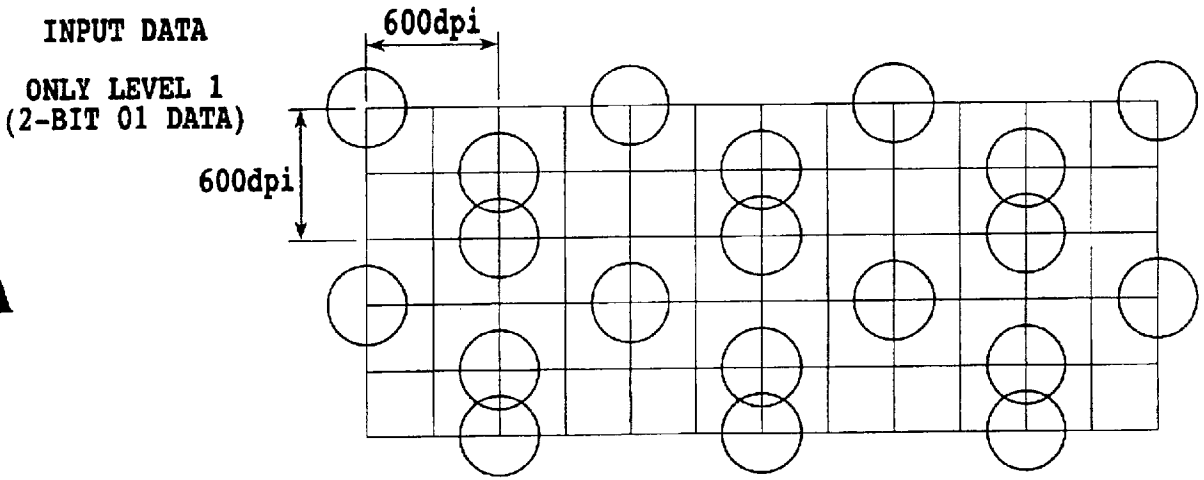
FIG. 9A is a schematic diagram showing a result of printing the spread pattern 01 of FIG. 8A to FIG. 8C.
Figure 9B:
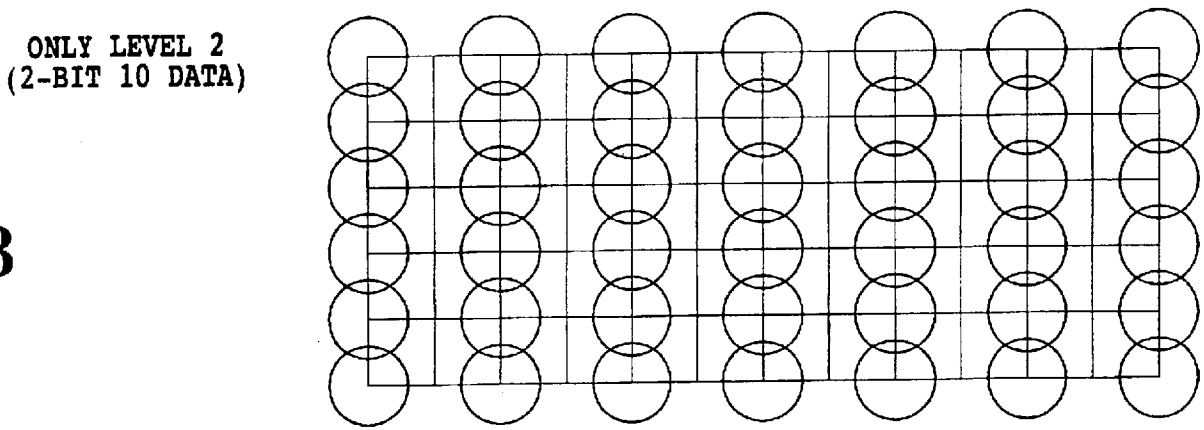
FIG. 9B is a schematic diagram showing a result of printing the spread pattern 10 of FIG. 8A to FIG. 8C.

FIGS. 9A and 9B show textures when the vertical dot arrangement patterns of FIGS. 8A–8C are printed. For the input data 01, portions of two vertically connected dots and portions of isolated single dots are uniformly distributed, but with different spaces between them in the column direction and in the raster direction (see FIG. 9A). This nonuniform dot-to-dot distance that differs between the column direction and the raster direction causes the printed dots to appear as blocklike clusters, giving granular impression. In this vertical arrangement, while the input data 01 produces an undesirable visual effect, the input data 10 does not result in any undesirable texture caused by the positional relation among the printed dots and they look uniform and are considered satisfactory.

The texture of the input data 01 that is used mainly in the low- to mid-tone range, such as shown in FIG. 7A and FIG. 9A, depends on the dot spread pattern. When the dots of the input data 01 are diagonally or vertically arranged, interferences are likely to occur among the data. In this embodiment, a check is made of the presence or absence of the data to be subjected to the spread processing and the spreading is done sequentially. Whether the dots are fixedly arranged irrespective of the print data or randomly arranged, interferences will occur in some tone range and this method does not provide a fundamental solution.

Next, the "overlapping arrangement" is examined. This method puts a plurality of dots in the same subpixel and, in this embodiment, can only be accomplished in multipass printing. When two dots in combination are put in one pixel, a dot coverage rate decreases and a density looks lower than when the two dots are arranged in different subpixels. Hence, to realize the similar density to those of other arrangement methods requires increasing the ink consumption, making this method less economical for the user and an unrealistic solution.

In the half-tone range, therefore, this embodiment distributes data through the "horizontal arrangement." The "horizontal arrangement" is an arrangement in which adjoining dots are arranged side by side in the same raster. This arrangement can only be accomplished in multipass printing, as with the "overlapping arrangement." The "horizontal arrangement" will be explained as follows.

Figure 10A:
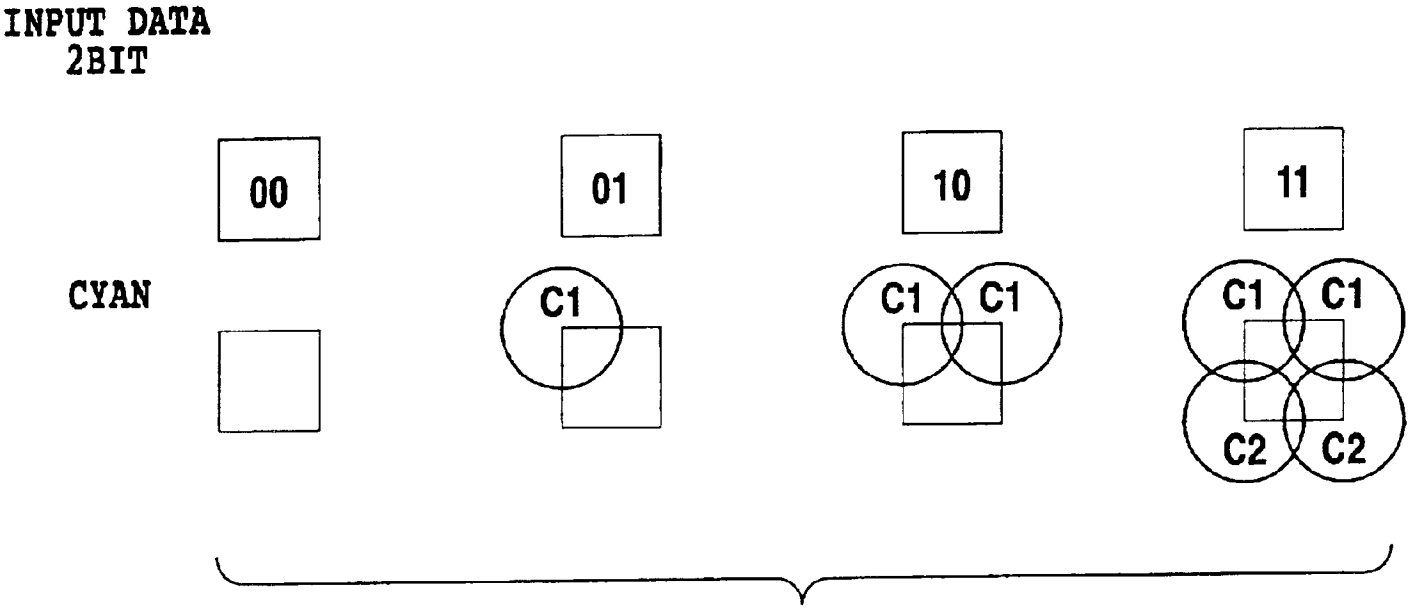
FIG. 10A is a schematic diagram showing a table specifying a cyan dot vertical arrangement.
Figure 10B:
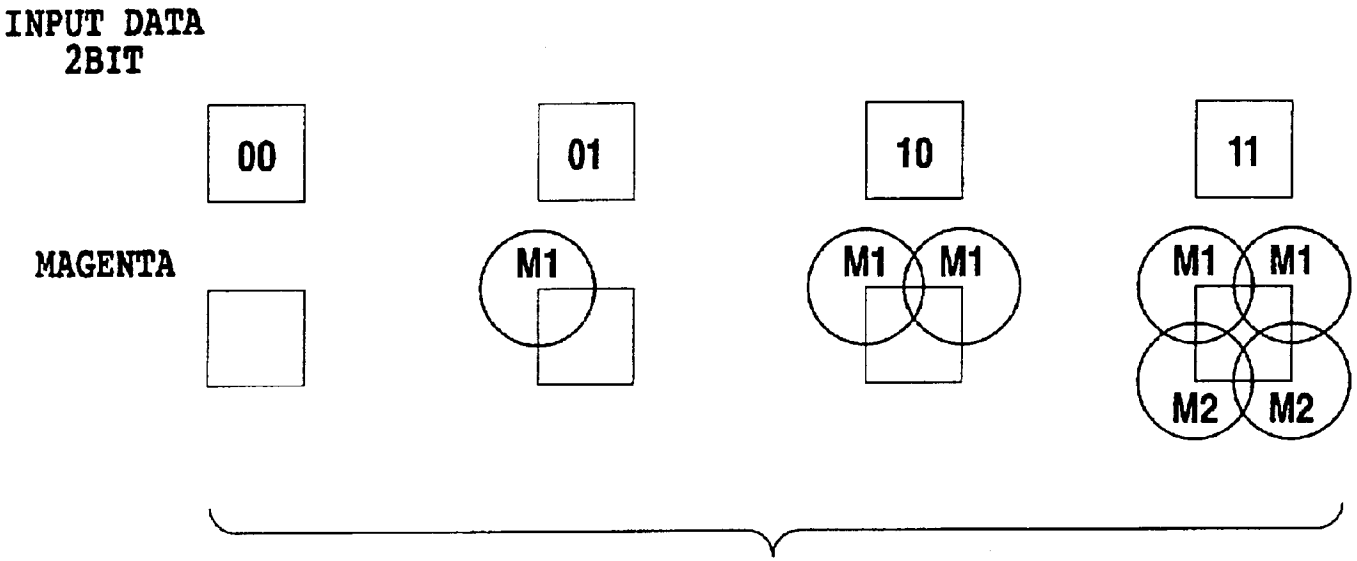
FIG. 10B is a schematic diagram showing a table specifying a magenta dot vertical arrangement.
Figure 10C:
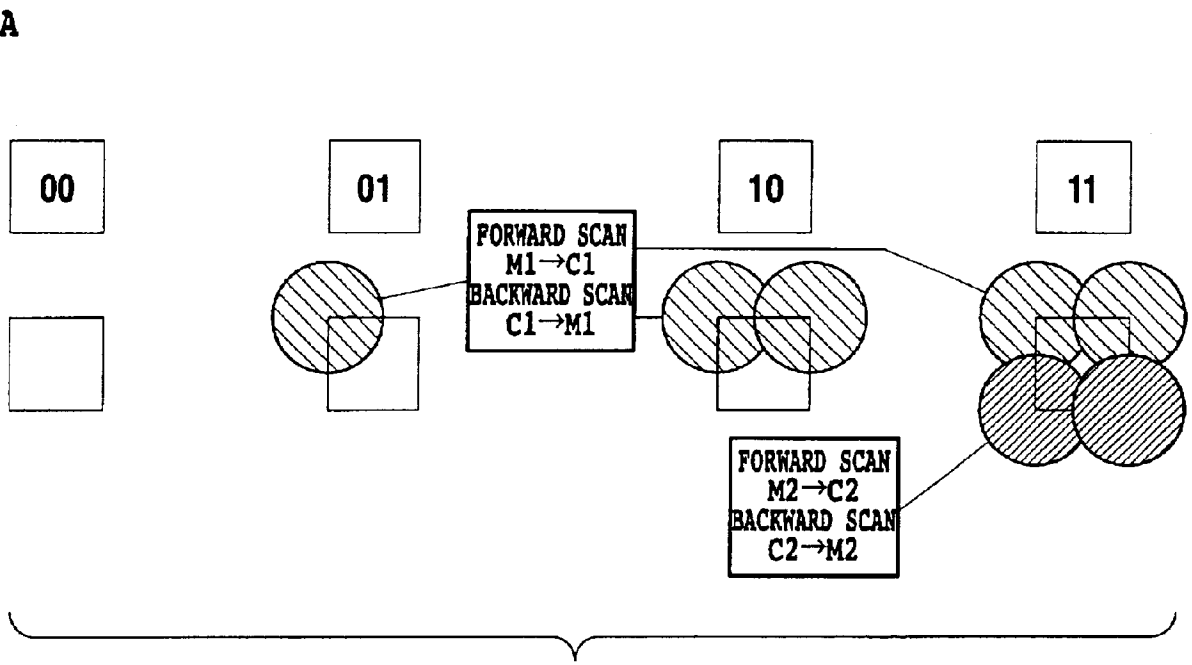
FIG. 10C is a schematic diagram showing a table specifying a blue dot vertical arrangement.

FIGS. 10A–10C show dots of the input data 01 and the input data 10 horizontally arranged in a pixel. As shown in the input data 10 of FIG. 10A, two cyan dots C1 are arranged laterally in the same pixel. In this case, as described above, since the dots in the same pixel cannot be printed in one pass, they are applied in two passes using mask processing. Since the data is not distributed among a plurality of rasters in the pixel, dots in the raster are distributed uniformly by a multipass mask between a forward scan and a backward scan, thus alleviating color variations.

Figure 11A:
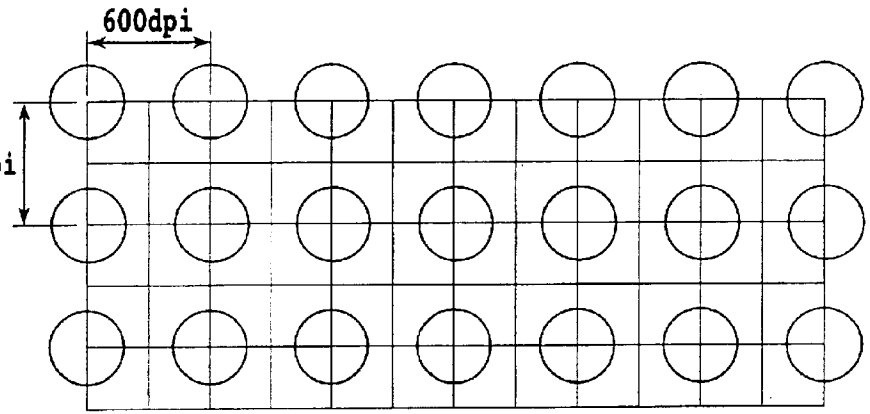
FIG. 11A is a schematic diagram showing a result of printing the spread pattern 01 of FIG. 10A to FIG. 10C.
Figure 11B:
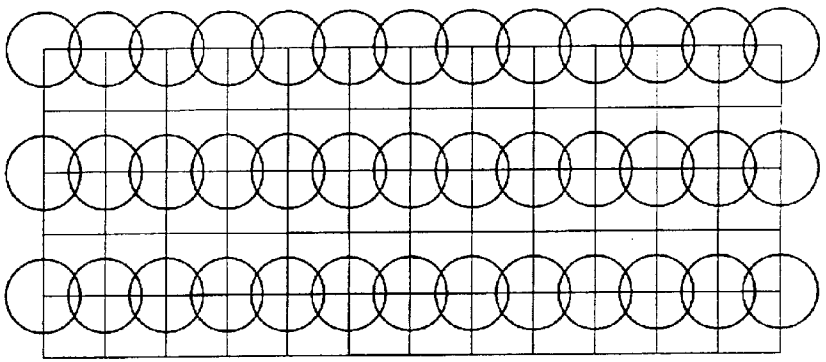
FIG. 11B is a schematic diagram showing a result of printing the spread pattern 10 of FIG. 10A to FIG. 10C.

FIG. 11A and FIG. 11B show dot patterns when printing is done using dot arrangements of FIGS. 10A–10C. For the input data 01 and the input data 10, the dot-to-dot distance is almost constant and the printed patterns show no undesired texture and appear uniform. As described above, in performing a multipass printing, a texture caused by a positional relation among dots can be reduced by not distributing the data among a plurality of rasters in the pixel but by limiting the data within the fixed raster.

However, with this horizontal arrangement, only one of the combined two print heads is used, raising a problem of durability. To deal with this problem, the number of ejected dots is counted for each of the combined print heads and when a predetermined dot number is exceeded, the operation is switched over to the other print head. This processing can solve the problem of an impartial distribution of the number of heating operations between the combined print heads. More detailed explanations are given below.

Referring again to FIG. 5, when input image data has a half-tone, the spread circuit 207 uses the "horizontal arrangement" spread patterns shown in FIGS. 10A–10C to spread the image data. It then maps the data in the associated buffer for each print head. In this buffer 205, dot counting is executed for each nozzle. When the count value exceeds a predetermined number, this is notified to the spread circuit 207.

In the next spread processing, the spread circuit 207 adjusts the pattern to spread the data to the print head that was not used in the previous spread processing or whose count value has not exceeded the predetermined value.

Such an operational switching between the print heads may be executed between pages or within the same page (between scans). However, performing the in-page head switching requires modifying a control of a fine mask at the switching point. In this embodiment therefore, the switching is executed between pages. The dot number is checked for each of the paired symmetric print heads and when the predetermined dot number is exceeded, the operation is switched over to another print head.

According to FIGS. 3A, 3B and FIGS. 4A, 4B, a plurality of the print heads are arrayed along the direction of the scanning the print head. However the prevent invention is not limited of this composition, another composition may be applied about a printing elements. For example, it may be one print head that formed unity of the plurality of the array of nozzles such as the array of print elements. The print head has, for each ink color, a plurality of the array of print elements (nozzle arrays), each of which is composed of the plurality of print elements which are arrayed at a predetermined interval. These arrays of print elements are arranged symmetric with respect to the scan direction of print head. Additionally, the print elements in one of the two print element array portions is shifted one-half the predetermined interval from the print elements of the other print element array portion in a direction of array of the print element. This composition can produce similar effect if print heads showed in FIGS. 3A, 3B and FIGS. 4A, 4B produce the printing.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively. In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, in an ink jet printing apparatus that employs a multipass printing mode and bidirectional symmetric print heads, this invention changes the spread pattern according to the state of the print data in pixel areas of process colors including secondary colors. This makes it possible to form an image that has secondary color dots uniformly spread. Not only can this uniform spreading prevent color variations, but it can also reduce the occurrence of undesired textures in, for example, a half-tone range. As a result, even when a bidirectional printing is executed, it is possible to reduce color variations caused by the scan direction change and a graininess that depends on the dot arrangements in the low- to mid-tone range.

Further, by changing the ink application order in the raster direction when forming secondary colors, bandlike color variations can be reduced.

Further, by performing mask processing in the raster direction, it is possible to print the spread-processed print data without changing the drive frequency of the print heads.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for printing a color image by using a print head having a plurality of print elements, the printing being performed by scanning the print head over one and the same scan area a plurality of times and by applying a plurality of color inks from the plurality of print elements to a print medium in both forward and backward directions of the scan, the print head including two print element array portions for each color disposed in a print head scanning direction, one of the two print element array portions being symmetric to the other print element array portion in an arrangement of ink colors, the plurality of print elements in one of the two print element array portions being shifted from the plurality of print elements in the other print element array portion in a direction of arrays of the print elements, said apparatus comprising:

a spread pattern to arrange secondary color pixel data uniformly in a raster direction, said spread pattern being used to determine an ink application position in a pixel area;

a data spreading means to generate the pixel data according to the spread pattern; and a spread pattern changing means to change the spread pattern used by said data spreading means according to a state of print data.

2. An ink jet printing apparatus according to claim 1, wherein said spread pattern changing means changes the spread pattern according to a tone of the print data.

3. An ink jet printing apparatus according to claim 1, wherein the spread pattern has a horizontal arrangement pattern for arranging dots in the raster direction when two dots are to be arranged in one pixel, and said spread pattern changing means uses the horizontal arrangement pattern when the tone of the print data is a half-tone.

4. An ink jet printing apparatus according to claim 1, further comprising a mask means to mask either an odd-numbered raster or an even-numbered raster arranged in a column direction of the pixel data generated by said data spreading means.

5. An ink jet printing apparatus according to claim 1, further comprising a count means to count the number of times that each of the print elements has been driven, wherein, when the print element drive number counted by said count means exceeds a predetermined value, said spread pattern changing means changes the spread pattern to a spread pattern that does not use those print elements that have exceeded the predetermined value.

6. An ink jet printing apparatus according to claim 1, further comprising an ink application order changing means, said ink application order changing means differentiating an ink application order in at least one of a plurality of secondary color pixel areas from those in other secondary color pixel areas, the secondary color pixel areas being arranged in the raster direction of the pixel data, wherein said spread pattern changing means changes the spread pattern to a spread pattern that uniformly distributes the secondary color pixel areas having different ink application orders.

7. An ink jet printing apparatus according to claim 6, wherein said ink application order changing means, based on an image signal corresponding to a color image, distributes the pixel data to print buffers provided one for each ink color in the print element array portions to differentiate the ink application order in at least one of a plurality of secondary color pixel areas from those in other secondary color pixel areas, the secondary color pixel areas being arranged in the raster direction of the pixel data.

8. An ink jet printing apparatus according to claim 1, wherein the print head has print elements for applying at least cyan, magenta and yellow ink.

9. An ink jet printing apparatus according to claim 8, wherein the print head further has print elements for applying a black ink.

10. An ink jet printing apparatus according to claim 1, wherein the print elements each have a nozzle for ejecting ink, generate a bubble in ink and eject an ink droplet from the nozzle by a pressure of the bubble as it expands.

11. An ink jet printing apparatus for printing a color image by using a print head having a plurality of print elements, the printing being performed by scanning the print head over one and the same scan area a plurality of times and by applying a plurality of color inks from the plurality of print elements to a print medium in both forward and backward directions of the scan, the print head including two print element array portions for each color disposed in a print head scanning direction, one of the two print element array portions being symmetric to the other print element array portion in an arrangement of ink colors, the plurality of print elements in one of the two print element array portions being shifted from the plurality of print elements in the other print element array portion in a direction of arrays of the print elements, said apparatus comprising:

a spread pattern to arrange secondary color pixel data uniformly in a raster direction, said spread pattern being used to determine an ink application position in a pixel area;

a data spreading means to generate the pixel data according to the spread pattern;

a spread pattern changing means to change the spread pattern used by said spreading means according to a state of print data; and a mask means to mask some of the pixel data generated by said data spreading means which correspond to a column located at a predetermined position in the raster direction.

12. An ink jet printing apparatus according to claim 11, wherein said mask means masks either an odd-numbered column or an even-numbered column.

13. An ink jet printing apparatus according to claim 11, wherein said mask means masks those pixel data that correspond to nearly half a plurality of secondary color pixel areas arranged in the column direction.

14. An ink jet printing apparatus according to claim 11, wherein said mask means masks those pixel data that correspond to nearly half a plurality of secondary color pixel areas arranged in the raster direction.

15. An ink jet printing method using an ink jet printing apparatus, wherein the ink jet printing apparatus prints a color image by using a print head having a plurality of print elements, the printing being performed by scanning the print head over one and the same scan area a plurality of times and by applying a plurality of color inks from the plurality of print elements to a print medium in both forward and backward directions of the scan, the print head including two print element array portions for each color disposed in a print head scanning direction, one of the two print element array portions being symmetric to the other print element array portion in an arrangement of ink colors, the plurality of print elements in one of the two print element array portions being shifted from the plurality of print elements in the other print element array portion in a direction of arrays of the print elements, the ink jet printing method comprising:

a data spreading step, of generating pixel data by using a spread pattern, the spread pattern being used to arrange secondary color pixel data uniformly in a raster direction and to determine an ink application position in a pixel area; and a spread pattern changing step, of changing the spread pattern used in said data spreading step according to a state of print data.

16. An ink jet printing method according to claim 15, wherein said spread pattern changing step includes changing the spread pattern according to a tone of the print data.

17. An ink jet printing method according to claim 16, wherein the spread pattern has a horizontal arrangement pattern for arranging dots in the raster direction when two dots are to be arranged in one pixel, and said spread pattern changing step includes using the horizontal arrangement pattern when the tone of the print data is half-tone.

18. An ink jet printing method according to claim 15, further comprising a mask step, of masking either an odd-numbered raster or an even-numbered raster arranged in a column direction of the pixel data generated in said spreading step.

19. An ink jet printing method according to claim 15, further comprising a count step of counting the number of times that each of the print elements has been driven, wherein, when the print element drive number counted in said count step exceeds a predetermined value, said spread pattern changing step includes changing the spread pattern to a spread pattern that does not use those print elements that have exceeded the predetermined value.

20. An ink jet printing method according to claim 15, further comprising an ink application order changing step, of differentiating an ink application order in at least one of a plurality of secondary color pixel area from those in other secondary color pixel areas, the secondary color pixel areas being arranged in the raster direction of the pixel data, wherein said spread pattern changing step includes changing the spread pattern to a spread pattern that uniformly distributes the secondary color pixel areas having different ink application orders.

21. An ink jet printing method according to claim 15, wherein the ink application order changing step includes distributing, based on an image signal corresponding to a color image, the pixel data to print buffers provided one for each ink color in the print element array portions to differentiate the ink application order in at least one of a plurality of secondary color pixel areas from those in other secondary color pixel areas, the secondary color pixel areas being arranged in the raster direction of the pixel data.

22. An ink jet printing apparatus for printing a color image by using a print head having a plurality of print element arrays having a plurality of print elements, the printing being performed by scanning the print head over one and the same scan area a plurality of times and applying a plurality of color inks from the print elements to a print medium in both forward and backward directions of the scan, the print head having two print element array portions for each color disposed in a print head scanning direction, one of the two print element array portions being symmetric to the other print element array portion in an arrangement of ink colors, the plurality of print elements in one of the two print element array portions being shifted from the plurality of print elements in the other print element array portion in a direction of arrays of the print elements, said apparatus comprising:

a data spreading means for generating an arrangement of dots being formed in one pixel, according to a spread pattern deciding each of ink applying position in a pixel area relative to each of a plurality of levels being expressed by pixel data; and a spread pattern changing means for changing the spread pattern according to a state of print data, so as to change the ink applying position in a pixel area, wherein said data spreading means generates the arrangement of dots, so as to be able to change an order of applying the plurality of ink forming a secondary color in the pixel area of the secondary color, and the print element array portions being used to form secondary colors selectively changing so as to differ an order of applying the plurality of inks forming a secondary color.

* * * * *

UNITED STATES PATENT AND TRADEMARK OFFICE

CERTIFICATE OF CORRECTION

PATENT NO. : 6,834,936 B2
DATED : December 28, 2004
INVENTOR(S) : Minoru Teshigawara et al.

It is certified that error appears in the above-identified patent and that said Letters Patent is hereby corrected as shown below:

Title page,
Insert -- [74], *Attorney, Agent, or Firm*—Fitzpatrick, Cella, Harper & Scinto --.

Column 4,
Line 5, “word” should read -- term --; and
Line 25, “DRAWING” should read -- DRAWINGS --.

Column 10,
Line 39, “form” should read -- from --.

Column 11,
Line 8, “raters” should read -- rasters --;
Line 24, “show” should read -- shows --; and
Line 59, “there” should read -- there is --.

Column 14,
Line 38, “prevent” should read -- present --;
Line 41, delete “unity of”; and
Line 52, “showed” should read -- shown --.

Column 18,
Line 5, “generate” should read -- generating --; and “eject” should read -- ejecting --.

Column 19,
Line 31, “area” should read -- areas --.

UNITED STATES PATENT AND TRADEMARK OFFICE

CERTIFICATE OF CORRECTION

PATENT NO. : 6,834,936 B2
DATED : December 28, 2004
INVENTOR(S) : Minoru Teshigawara et al.

It is certified that error appears in the above-identified patent and that said Letters Patent is hereby corrected as shown below:

Column 20,
Line 25, “position” should read -- positions --; and
Line 33, “ink” should read -- inks --.

Signed and Sealed this

Seventh Day of June, 2005

JON W. DUDAS
*Director of the United States Patent and Trademark Office*